US008511294B2

(12) United States Patent
Paesani

(10) Patent No.: US 8,511,294 B2
(45) Date of Patent: Aug. 20, 2013

(54) GAS BURNER FOR COOKING APPLIANCES

(75) Inventor: Carlo Paesani, Camerano (IT)

(73) Assignee: Defendi Italy S.R.L., Camerano (IT)

( * ) Notice: Subject to any disclaimer, the term of this patent is extended or adjusted under 35 U.S.C. 154(b) by 765 days.

(21) Appl. No.: 12/289,655

(22) Filed: Oct. 31, 2008

(65) Prior Publication Data

US 2009/0145422 A1 Jun. 11, 2009

(30) Foreign Application Priority Data

Dec. 11, 2007 (IT) ..... VE2007A0096

(51) Int. Cl.
*F24C 3/08* (2006.01)

(52) U.S. Cl.
USPC .... 126/39 E; 126/39 R; 126/39 H; 126/41 R; 431/266; 431/284

(58) Field of Classification Search
USPC ..... 126/39 E, 39 R, 39 H, 41 R; 431/354, 431/284, 266, 258; 239/558, 559, 543, 550, 239/552
See application file for complete search history.

(56) References Cited

U.S. PATENT DOCUMENTS 1,923,393 A * 8/1933 Pickup ..... 239/543
2,029,471 A * 2/1936 Field et al. ..... 431/237
2,208,956 A * 7/1940 Allenbaugh ..... 431/60
4,518,346 A * 5/1985 Pistien ..... 431/266
5,488,942 A * 2/1996 Maughan ..... 126/39 E
6,244,263 B1 * 6/2001 Schlosser et al. ..... 126/39 R
6,263,868 B1 7/2001 Koch et al.
6,315,552 B1 * 11/2001 Haynes et al. ..... 431/285
6,332,460 B1 * 12/2001 Paesani ..... 126/39 R
6,537,065 B1 * 3/2003 Shirali et al. ..... 431/354
7,017,572 B2 * 3/2006 Cadima ..... 126/39 E
2006/0051718 A1 * 3/2006 Kamal et al. ..... 431/354

OTHER PUBLICATIONS

U.S. Appl. No. 11/795,751, filed Jan. 20, 2007—Carlo Paesani.

* cited by examiner

*Primary Examiner* — Avinash Savani
(74) *Attorney, Agent, or Firm* — Themis Law

(57) ABSTRACT

A gas burner for cooking appliances employing a ring of main flames for cooking, and a ring of simmering flames for heating. A first chamber contains the gas and primary air mixture for feeding the ring of main flames through a circumferential wall with a plurality of radial apertures. The chamber contains the gas and primary air mixture for feeding the ring of simmering flames through radial passages. The chambers are superposed, and a separator plate is interposed between the chambers. A cover rests on the separator plate and the radial apertures are defined therebetween. The cover extends beyond the passage and shields same from ambient conditions.

15 Claims, 5 Drawing Sheets

GAS BURNER FOR COOKING APPLIANCES

The present invention relates to a gas burner for cooking appliances.

Gas burners with one or more flame rings are known, in particular gas burners with a ring of main flames positioned at a certain level of the burner and a ring of simmering flames positioned at a different level.

The main flame ring is used to deliver the power required for high temperature cooking, whereas the simmering flame ring is used to provide minimum power delivery, to be used for low temperature cooking; the lower the temperature provided by the simmering flame ring, the better the burner performance.

BACKGROUND OF THE INVENTION

U.S. Pat. No. 6,263,868 granted Jul. 24, 2001, to J. Koch et al, describes a gas burner with two flame rings positioned at different heights, namely a main flame ring positioned at a higher level and a simmering flame ring positioned at a lower level. However the simmering flame ring is disposed on the circumferential wall of the burner and is sensitive to those air movements which inevitably occur on the cooking hob. Moreover, the primary air feeding the simmering flame ring originates from below the cooking hob with the result that this ring, already fed with a minimum gas flow and sensitive to air movements on the cooking hob, is also sensitive to the streaming effect, i.e. the pressure reduction to which the primary air flow is exposed following opening of a door positioned below the cooking hob, which can result in extinguishing of the simmering flames.

Another gas burner with two flame rings, positioned at different heights, namely a main flame ring for high temperature cooking and a simmering ring flame for heating, is shown in applicant's co-pending application Ser. No. 11/795,751, presently pending Group Art Unit 3749.

BRIEF SUMMARY OF THE INVENTION

An object of the invention is to provide a gas burner for cooking appliances which is provided with a simmering flame ring but is free from the drawbacks recognizable in gas burners of this type.

Another object of the invention is to provide a gas burner in which the simmering flame ring can be fed with a minimum gas flow, that is far less than that at which in traditional burners can function satisfactorily. The instant gas burner employs a cover, with an outwardly extending edge that shields the passages feeding the ring of simmering flames from ambient conditions or disturbances.

Another object of the invention is to provide a gas burner with a simmering flame ring in which injector access is particularly simple, to enable replacement if the appliance is to be adapted for different gas types.

Another object of the invention is to provide a gas burner with a minimum number of parts that leads to economy of manufacture, reliable operation, and ease of installation both in cooking hobs and in gas cookers.

Another object of the invention is to provide a gas burner of extremely small height attributable to superimposed chambers, and hence capable of installation in cooking hobs of minimum thickness.

These and other objects will be apparent from the ensuing drawings and specification of an exemplary gas burner for cooking appliances.

BRIEF DESCRIPTION OF THE DRAWINGS

Two related embodiments of the present invention are further described hereinafter with reference to the accompanying drawings, in which.

DETAILED DESCRIPTION

Figure 1:
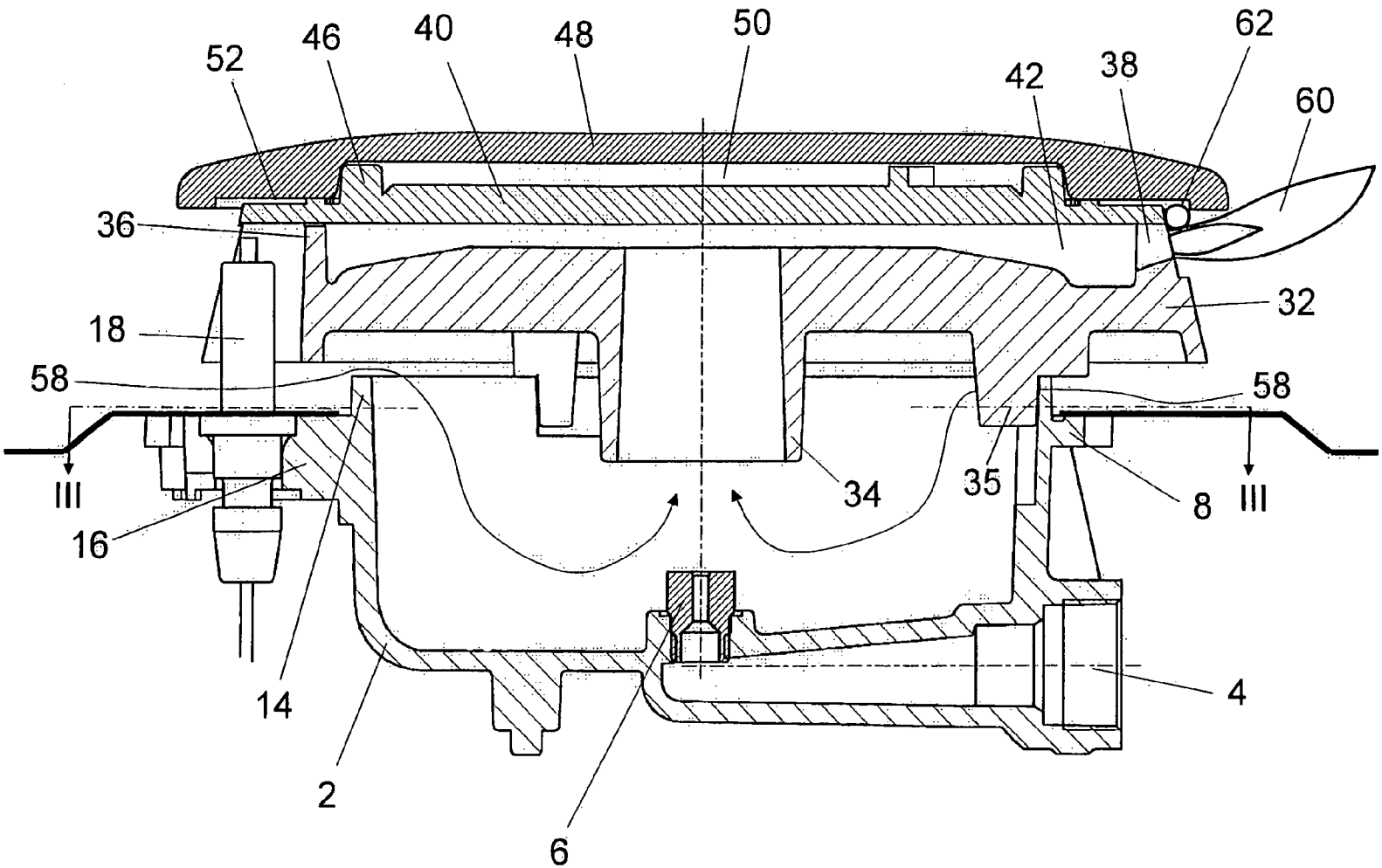
FIG. 1 is a vertical section through a burner of the invention taken on the plane I-I of FIG. 3 passing through the axis of the main injector, in the embodiment with the primary air takeoff for the main flame ring located above the cooking hob.

As can be seen from the figures, the burner of the invention comprises, in the embodiment shown in FIGS. 1-5, a cup-shaped support 2 closed at its base and provided with a first inlet 4 for the gas feeding a first injector 6, which is positioned in the center of said base and is intended to feed the main flame ring.

The cup-shaped support 2 is provided with a flange 8, by which it rests on the lower surface of the cooking hob 10, formed of sheet metal, at an aperture provided therein. Screws 12 fix the support to hob 10.

The cup-shaped support 2 extends beyond the hob 10 as a raised edge 14 and is also provided, below said hob, with a radial appendix 16 supporting an ignition spark plug 18 and a thermocouple 20.

The cup-shaped support 2 is also provided with a second inlet 22 for the gas which feeds a second injector 24 positioned eccentrically to the first injector 6 and is intended to feed the simmering flame ring.

Because of the minimum gas flow for the simmering flames, the outflow hole of this second injector 24 is substantially smaller than the outflow hole provided in the first injector 6.

The two injectors 6 and 24 are fed via a single valve (not shown) which, depending on the position of its control knob, feeds gas to either both the injectors 6 and 24, or to only the second injector 24.

This second injector 24 is housed in a cylindrical chamber 26 provided in the same cup-shaped support 2 and bounded by a cylindrical wall 28, in which an aperture 30 is provided. A flame divider 32 rests on the raised edge 14 of the cup-shaped support 2. An axial conduit 34 of frusto-conical shape is coaxial to the first injector 6, and has its lower aperture facing the injector.

Flame divider element 32 comprises three equiangular appendices 35 provided with a step, as shown in FIG. 1. The appendices rest on the edge 14 of the cup-shaped support and maintain the flame divider element 32 spaced above the cooking hob 10 to define passages for the primary air to be mixed with the gas leaving the nozzle 6, as described hereinafter.

The upper surface of the flame divider element 32, which centrally accommodates the upper opening of the frusto-conical conduit 34, slightly degrades towards the periphery, where it comprises a wall 36, in which a plurality of apertures 38 are provided for the outflow of the gas/primary air mixture feeding the main flame ring.

A separator element, or plate, 40 rests on the upper edge of wall 36, defining with the underlying flame divider element 32, a chamber 42 for feeding the main flame ring via the apertures 38.

In a different embodiment, not shown in the drawings but equivalent to the preceding, the apertures 38 for feeding the main flames are not provided in the peripheral wall 36 of the flame divider element 32 but are instead provided in a similar peripheral wall in the separator element 40.

In the flame divider element 32 a second conduit 43 is also provided which, when the burner is mounted, is coaxial with the second injector 24 and has its upper edge 44 inserted in a corresponding circular aperture provided in the separator element 40. Separator element, or plate 40, is provided with lugs 46 for positioning and centering cover 48 on the burner assembly.

Cover 48, which cooperates with the separator element 40, defines a chamber 50 for feeding the simmering flame ring. Cover 48 has its edge projecting below the underlying periphery of the separator element 40, to define therewith the passages for the gas-primary air mixture to feed the simmering flames.

Figure 5:
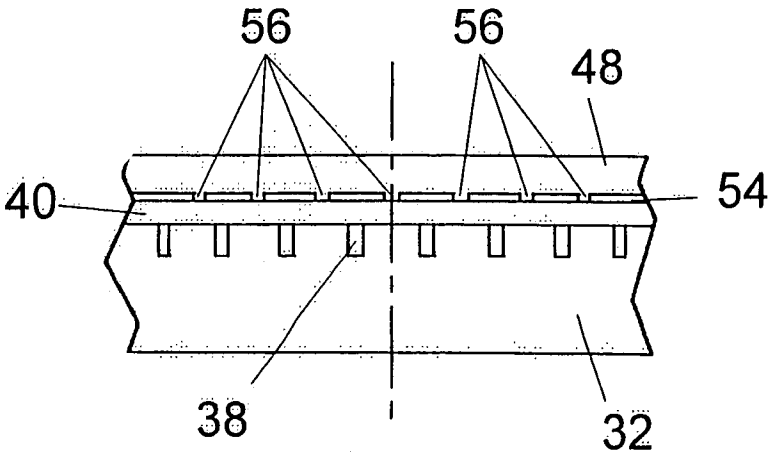
FIG. 5 is a view similar to FIG. 4, but showing the feed aperture for the simmering flame ring assuming the form of a slit interrupted by a plurality of bars.

These passages consist of a thin continuous slit 52 (see FIG. 4) or a thin discontinuous slit 54, obtained by providing in the cover 48, or in the separator element 40, a plurality of equidistant bars 56 (see FIG. 5).

The aforedescribed burner operates in the following manner.

If the knob controlling the gas feed valve is operated and set on the maximum gas delivery position (generally at 90°), the gas is fed to both the injectors 6 and 24. As the cup-shaped support 2 has a completely closed base, the gas leaving the injector 6 entrains a primary air flow from above the cooking hob 10 and into the conduit 34 along the path indicated by the arrows 58 in FIG. 1. The gas and primary air flows arrive in the chamber 42, where they mix by the venturi effect, their mixture then feeding the main flame ring 60 via the apertures 38.

Figure 2:
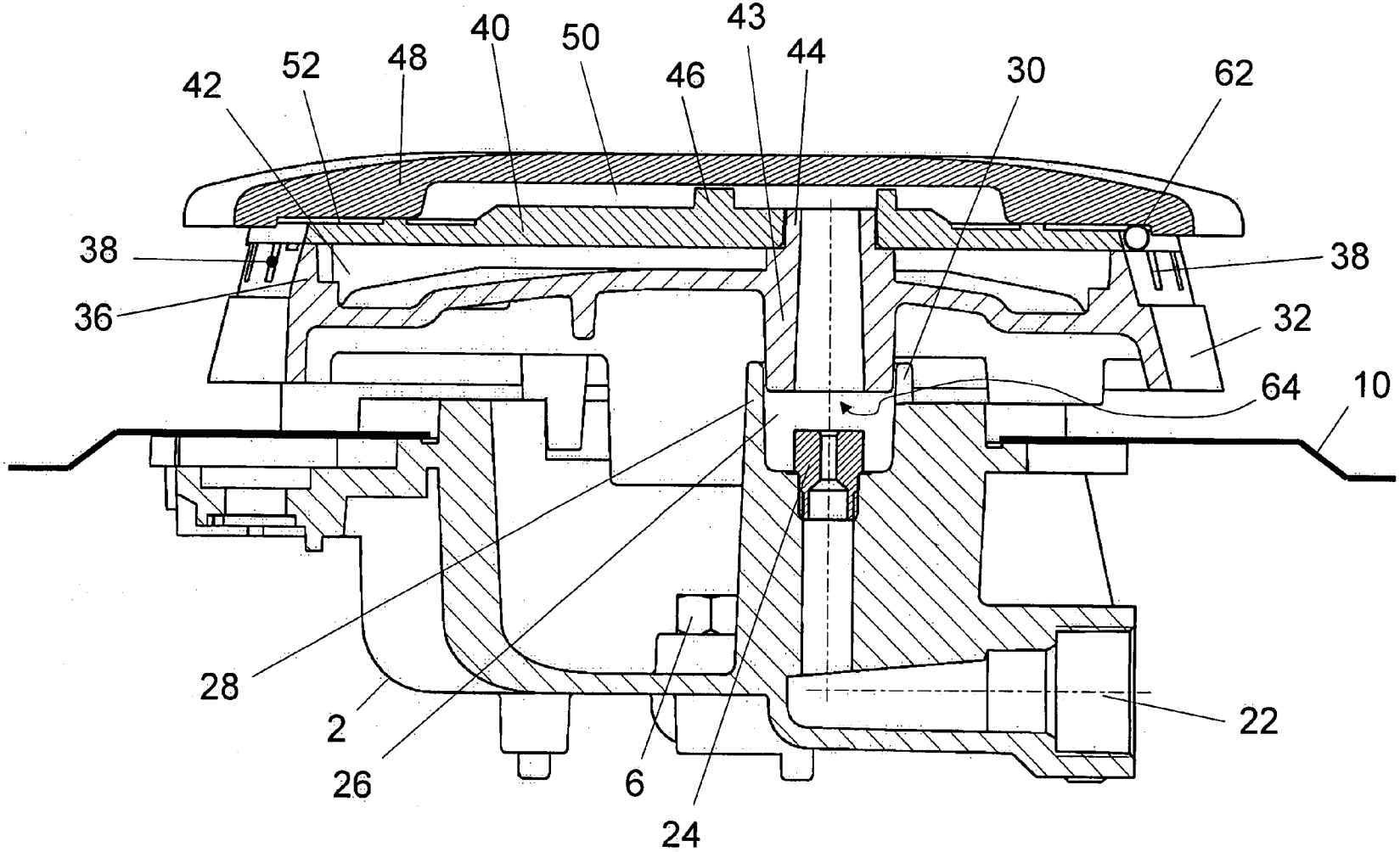
FIG. 2 shows a different vertical section therethrough, taken on the plane II-II of FIG. 3.
Figure 3:
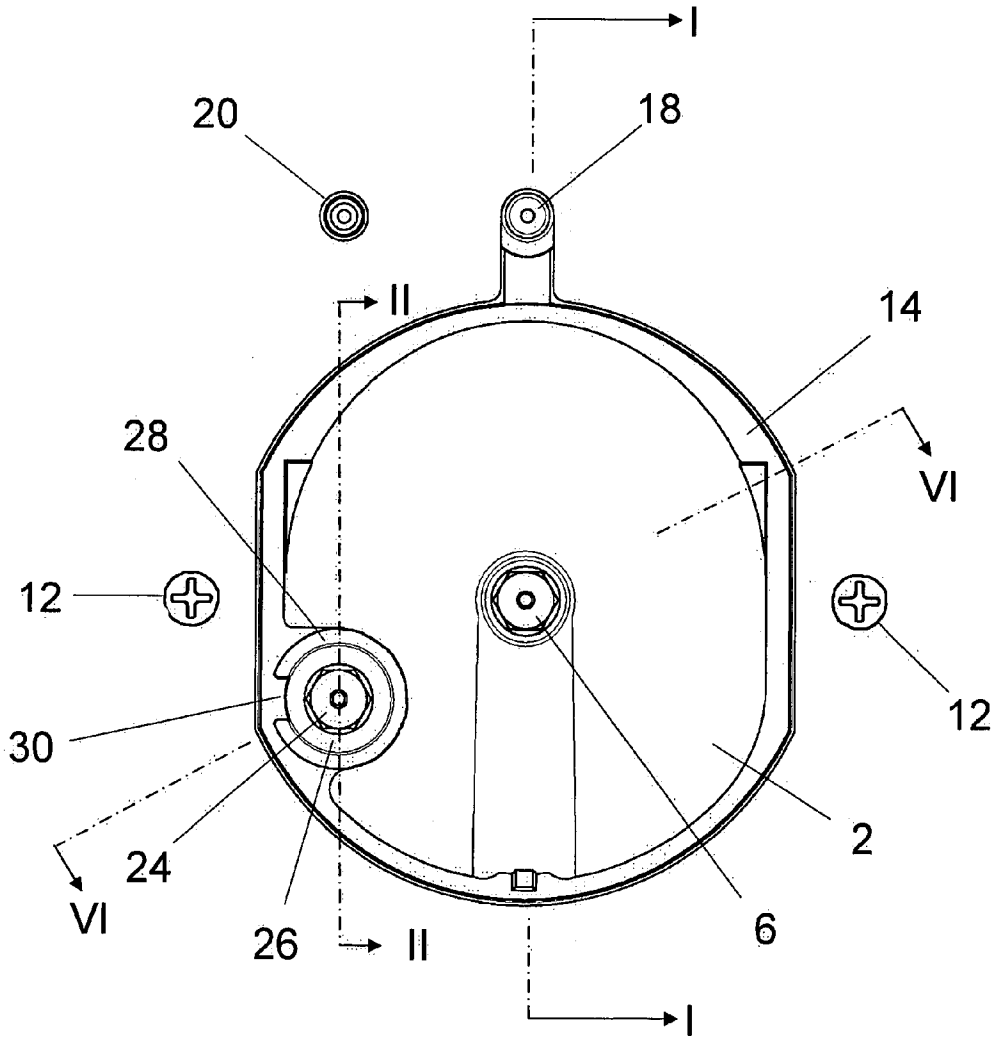
FIG. 3 is a horizontal section therethrough on the plane III-III of FIG. 1.
Figure 4:
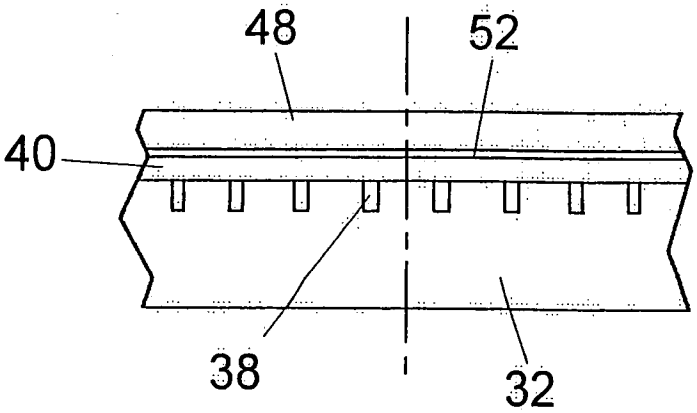
FIG. 4 is a schematic side view of a burner portion with the with the aperture for feeding the simmering flame ring assuming the form of a continuous slit.

At the same time the gas leaving the injector 24, in a quantity much less than that leaving the injector 5, entrains further primary air, again taken from above the cooking hob, through the aperture 30 provided in the wall 28 of the chamber 26, in which the injector is housed, to follow the path indicated by the arrow 64 in FIG. 2. The gas and primary air flows pass through the conduit 43 and form in the chamber 50 a mixture which feeds the simmering flames, either as a blade of flame or as separate small flames, depending on which of the two types of burner shown in FIGS. 4 and 5 is used, in both cases they combining with the main flames 60.

If the user rotates the control knob for the gas feed valve away from the 90° position, the main flames decrease and become zero when the control knob is fully rotated. In this position only the simmering flames 62 remain ignited, these on the one hand being protected from ambient conditions and disturbances by the projecting edge of the cover 48 and hence being stable and, on the other hand, being fed by primary air withdrawn from above the cooking hob. Consequently, the ring of simmering flames is insensitive to the streaming effect.

It follows that the gas feeding the simmering flames 62 can be adjusted to a particularly low value, this enabling the burner power to be reduced to a value not previously achieved with known gas burners, while ensuring satisfactory flame stability under all conditions.

Figure 6:
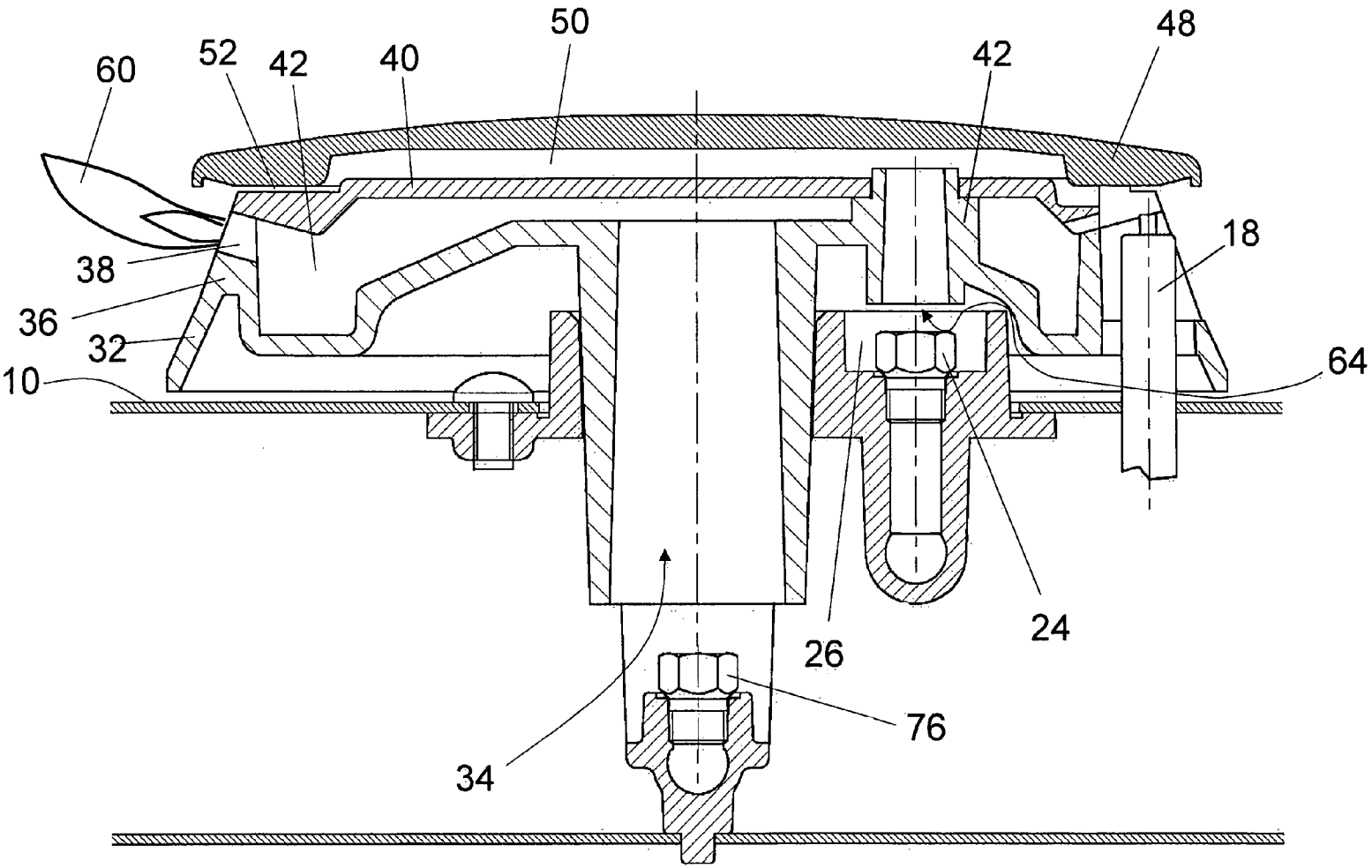
FIG. 6 shows a different vertical section, through a different embodiment of the burner, taken on the plane VI-VI in FIG. 3 passing through the axis of the main injector and of the simmering injector, with the primary air takeoff for the main flame ring located below the cooking hob.

In the embodiment shown in FIG. 6, while maintaining the principle of feeding the simmering flames with primary air withdrawn from above the cooking hob, and again being positioned above the main flames and protected by the projecting edge of the cover 48, the primary air for feeding the main flame ring is withdrawn from below the cooking hob, with all the implications which this solution predictably involves.

Other modifications and revisions may occur to the skilled artisan without departing from the spirit and scope of the present invention. Thus, the appended claims should be broadly construed in a manner commensurate with applicants' invention, and should not be restricted to their literal terms.

What is claimed is:

1. A gas burner for a cooking appliance comprising:

a cup shaped support having a closed base and a first inlet for a gas feeding first injector, said gas feeding first injector being positioned on said base;

a first chamber having a first intake for a first mixture of gas coming from said first injector with primary air coming from a first air inlet, said first mixture feeding a ring of main flames;

a second chamber placed above said first chamber, said second chamber opening upwardly, being fluidly separated from said first chamber and having a second intake for a second mixture of gas, coming with a constant flow rate from a second injector, with primary air, coming from a second air inlet disposed above a cooking hob where the gas burner is disposed, said second mixture feeding a substantially continuous and annular simmering flame, said first and said second inlets being separate, said second air inlet and said second chamber being fluidly connected by a path formed below and through said first chamber;

a circumferential wall having a plurality of radial apertures allowing an outflow of said first mixture to feed said ring of main flames;

a discoidal septal wall separating said first and said second chambers;

a cover for upper closure of said second chamber; and a substantially continuous annular passage defined between a lower surface of said cover and an upper surface of said septal wall, said annular passage allowing an outflow of said second mixture from said second chamber to feed said annular simmering flame, wherein said cover has a circumferential edge extending outwardly beyond said annular passage to shield said annular passage and said annular simmering flame from ambient conditions.

2. The gas burner of claim 1, wherein said circumferential wall extends around said first chamber, and wherein said septal wall rests on an upper end of said circumferential wall, a lower surface of said septal wall defining a boundary of said first chamber and said upper surface of said septal wall defining a boundary of said second chamber.

3. The gas burner of claim 1, wherein said cup shaped has an upwardly opening top, a flange located adjacent the upwardly opening top being configured to rest on a lower surface of said cooking hob.

4. The gas burner of claim 3, wherein a raised edge of said cup shaped support extends upwardly above said flange and said cooking hob, and wherein a flame divider element rests upon said support.

5. The gas burner of claim 4, wherein said flame divider element is spaced from said cooking hob by a distance sufficient to create a passage for said primary air to feed said ring of main flames and said ring of said annular simmering flame.

6. The gas burner of claim 1, wherein said septal wall is provided at its lower edge with the circumferential wall, and wherein radial apertures are provided in said circumferential wall to provide for flow of said primary air and gas mixture to the ring of main flames.

7. The gas burner of claim 1, wherein said second chamber containing said second mixture feeding said annular simmering flame is bounded at a lower end by said septal wall and at an upper end by said cover.

8. The gas burner of claim 1, wherein said septal wall is provided on its upper surface with centering lugs for receiving said cover.

9. The gas burner of claim 8, further comprising a cup-shaped support provided with a closed base and with a flange having an upper edge configured to rest on a lower surface of said cooking hob at an aperture provided therein.

10. The gas burner of claim 9, wherein said cup-shaped support extends upwardly beyond said flange to provide a raised edge emerging from said cooking hob, a flame divider element resting thereon.

11. The gas burner of claim 10, wherein said cup-shaped support is provided with two separate gas inlets, two separate injectors being respectively associated with said separate gas inlets and respectively feeding the main flame ring and annular simmering flame ring, said flame divider element being provided with two tubular conduits respectively facing said injectors.

12. The gas burner of claim 11, wherein the tubular conduit receiving said second mixture extends upwards beyond said flame divider element, passes through said septal wall and opens into said second chamber feeding said annular simmering flame.

13. The gas burner of claim 10, wherein said flame divider element is spaced from said cooking hob by a distance sufficient to create a passage for the primary air intended to feed said ring of main flames and said annular simmering flame.

14. The gas burner of claim 10, wherein said flame divider element is provided at its lower end with appendices for resting on the raised edge of said cup-shaped support.

15. The gas burner of claim 10, wherein said flame divider element is provided with a circumferential wall, and wherein radial apertures are provided in said wall for passage of said first mixture to said ring of main flames.

* * * * *